US005961368A

United States Patent [19]

Chu

[11] Patent Number: 5,961,368

[45] Date of Patent: Oct. 5, 1999

[54] DIFFERENTIAL STRUCTURE OF REMOTELY CONTROLLED TOY CAR

[76] Inventor: Yu-Po Chu, 5F, No. 11, Lane 233, Sec. 1, Tui-Hua South Rd., Taipei, Taiwan

[21] Appl. No.: 09/114,247

[22] Filed: Jun. 29, 1998

[51] Int. Cl.[6] ..... A63H 29/00

[52] U.S. Cl. ..... 446/457; 446/462; 475/249

[58] Field of Search ..... 475/248, 249, 475/250, 252; 446/457, 460, 461, 462

[56] References Cited

U.S. PATENT DOCUMENTS

| | | | |
|---|---|---|---|
| 1,407,703 | 2/1922 | Moir | 475/249 |
| 1,756,939 | 5/1930 | Crawford | 475/249 |
| 1,948,095 | 2/1934 | Boynton | 475/249 |
| 4,712,449 | 12/1987 | Avny | 475/252 |
| 4,762,022 | 8/1988 | Johnshoy | 475/249 |
| 4,916,978 | 4/1990 | Razelli et al. | 475/249 |

*Primary Examiner*—Robert A. Hafer
*Assistant Examiner*—Jeffrey D. Carlson
*Attorney, Agent, or Firm*—Dougherty & Troxell

[57] ABSTRACT

A differential structure of remotely controlled toy car, including a housing, a gear set installed in the housing and a left and a right shafts the ends of which extend out of two sides of the housing for connecting with wheel shafts. Each of the left and right shafts has a front end formed with spiral teeth meshing with two upright spiral gears on two sides. Each two adjacent left and right upright spiral gears mesh with one transverse spiral gear therebetween. During turning, by means of the engagement between the upright, transverse and upright sprial gears, a good differential modulation is achieved between the left and right shafts. Also, a sufficient torque is provided to prevent the wheels from slipping.

4 Claims, 5 Drawing Sheets

DIFFERENTIAL STRUCTURE OF REMOTELY CONTROLLED TOY CAR

BACKGROUND OF THE INVENTION

The present invention relates to a differential structure for a remotely controlled toy car, which employs less gears to lower the cost and achieves a good differential effect with sufficient torque.

FIGS. 5 and 6 show a conventional differential used in a remotely controlled toy car. Four conic gears 91 meshing with each other are installed in a housing to provide differential adjustment for left and right shafts 81, 82 during turning. The conic gears 91 are engaged with each other in a line-to-plane relationship. In the case of high rotary speed, the conic gears 91 are quite subject to abrasion. Therefore, the parts are frequently replaced. FIG. 7 shows an improved differential in which spiral gears 92 are disposed between the left and right shafts 81, 82. The adjacent spiral gears 92 are engaged with bevel gears 93 on upper and lower sides. When rotated, the engaged spiral gears 92 and the bevel gears 93 transmit the power, whereby an apparent differential effect is achieved between the left and right shafts 81, 82. Therefore, during turning, the wheel on one side runs faster, while the wheel on the other side runs slower so as to avoid slipping. In such structure, the number of the gears is up to 14 so that the manufacturing and assembling procedure is complicated and the cost is increased. Moreover, the bevel gears are paralley engaged with each other. This fails to provide maximum torque.

SUMMARY OF THE INVENTION

It is a primary object of the present invention to provide a differential structure for a remotely controlled toy car, which employs less gears and is able to achieve good differential effect with sufficient torque.

According to the above object, the differential structure of the present invention includes a housing, a gear set installed in the housing, and left and right shafts the ends of which extend out of two sides of the housing for connecting with wheel shafts. Each of the left and right shafts has a front end formed with spiral teeth meshing with two upright spiral gears on two sides. Each two adjacent left and right upright spiral gears mesh with one transverse spiral gear therebetween. During turning, by means of the engagement between the upright, transverse and upright sprial gears, a good differential modulation is achieved between the left and right shafts. Also, a sufficient torque is provided to prevent the wheels from slipping.

The present invention can be best understood through the following description and accompanying drawings, wherein:

DETAILED DESCRIPTION OF THE PREFERRED EMBODIMENT

Figure 1:
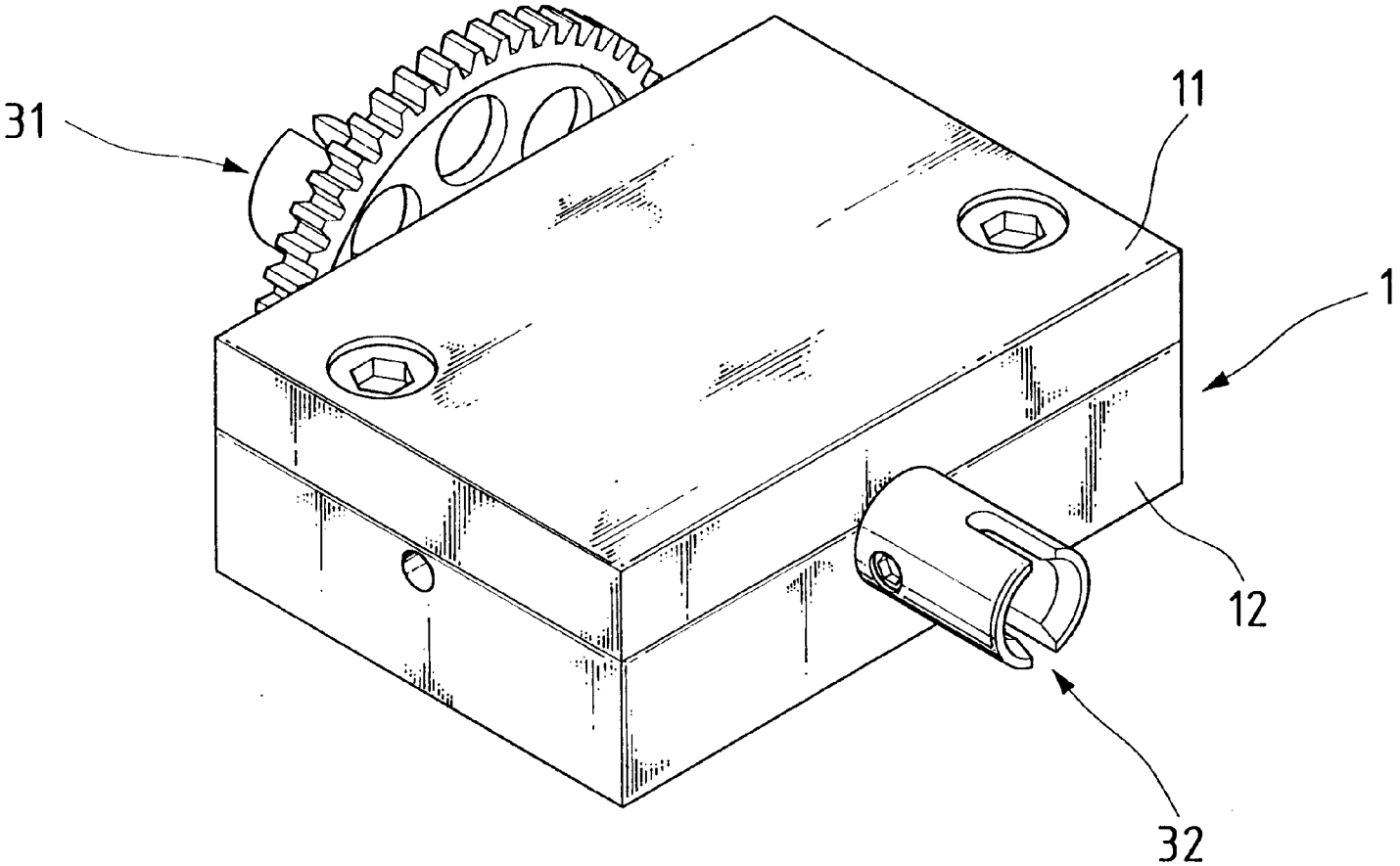
FIG. 1 is a perspective assembled view of the present invention.
Figure 2:
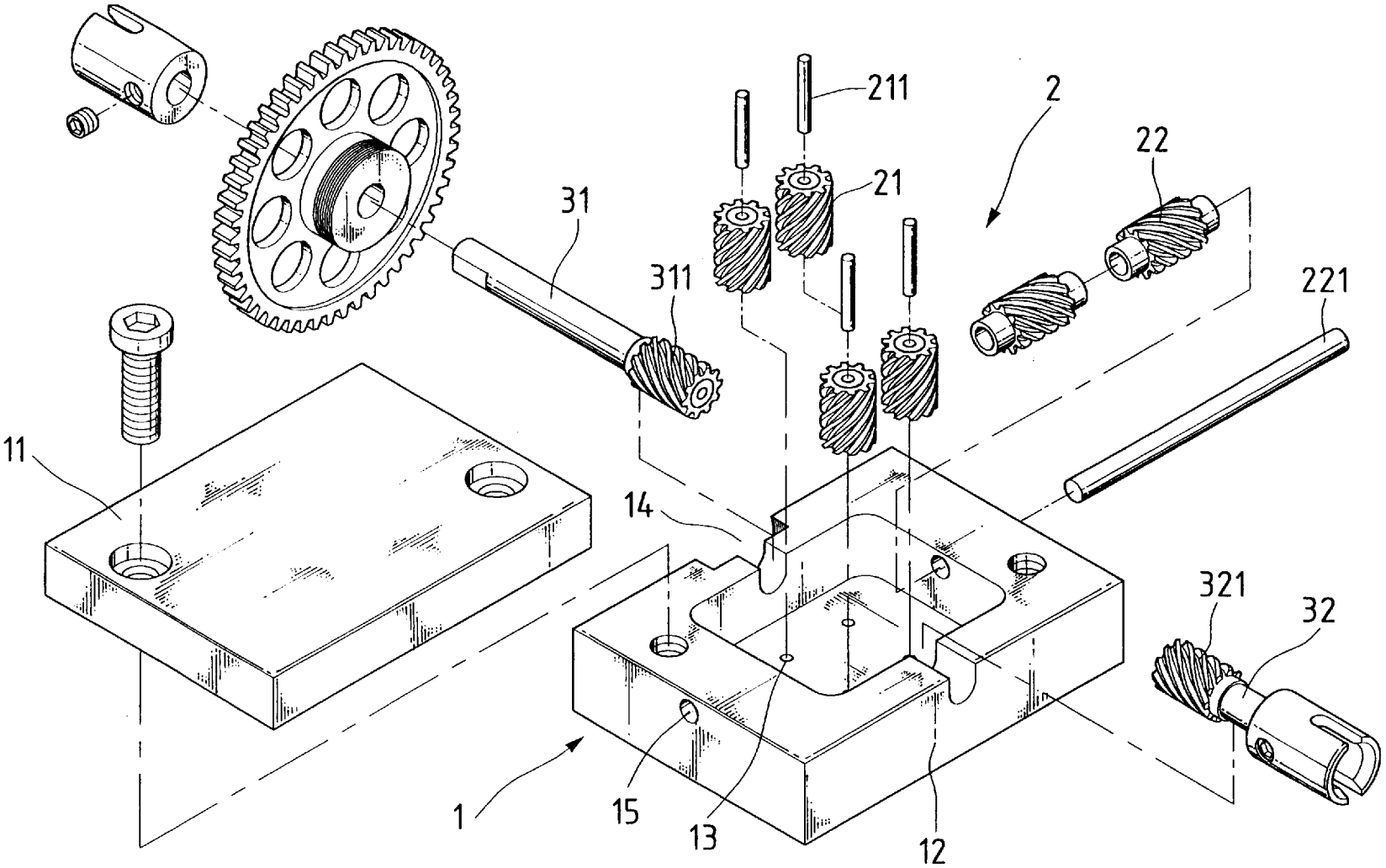
FIG. 2 is an exploded, perspective view of the present invention.
Figure 3:
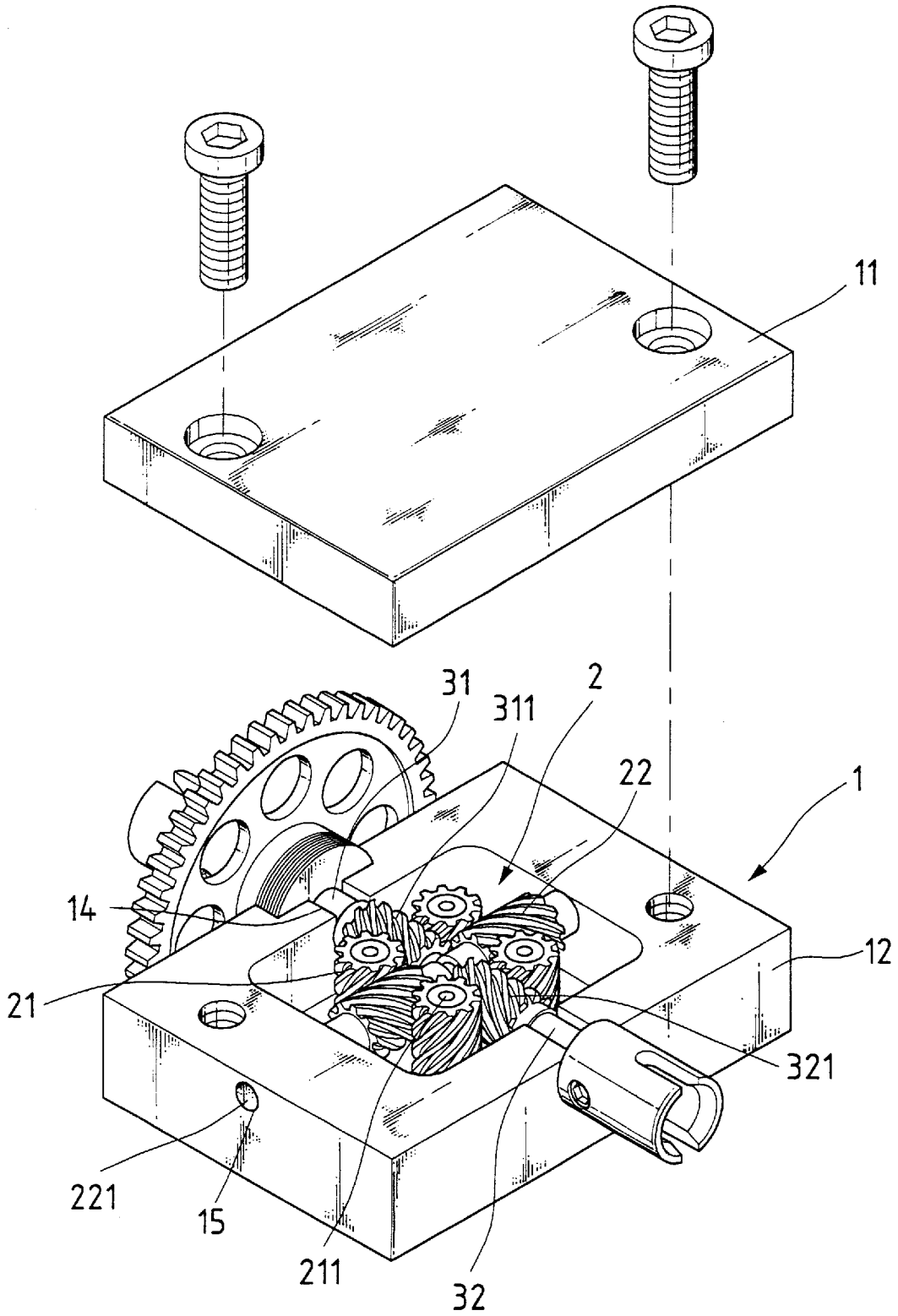
FIG. 3 is a perspective assembled view of the present invention with the upper casing removed.

Please refer to FIGS. 1, 2 and 3. The differential of the present invention includes a housing 1, a gear set 2 installed in the housing 1, and left and right shafts 31, 32 the ends of which extend out of two sides of the housing 1 for connecting with wheel shafts.

The housing 1 is composed of upper and lower casings 11, 12 mated with each other. The housing 1 is formed with two cut holes 14 on two sides for the ends of the left and right shafts 31, 32 to extend therethrough out of the housing 1 for connecting with wheel shafts.

The opposite faces of the upper and lower casings are formed with four dents 13 in which rotary shafts 211 are fitted for locating four upright spiral gears 21. The casings are formed with through holes 15 perpendicular to the cut holes 14 for fitting therein a central shaft 221 passing through and locating two transverse spiral gears 22, whereby each two adjacent left and right upright spiral gears 21 mesh with one transverse spiral gear 22 therebetween.

Each of the left and right shafts 31, 32 has a front end formed with spiral teeth 311, 321 meshing with two upright spiral gears 21 on two sides.

Figure 4:
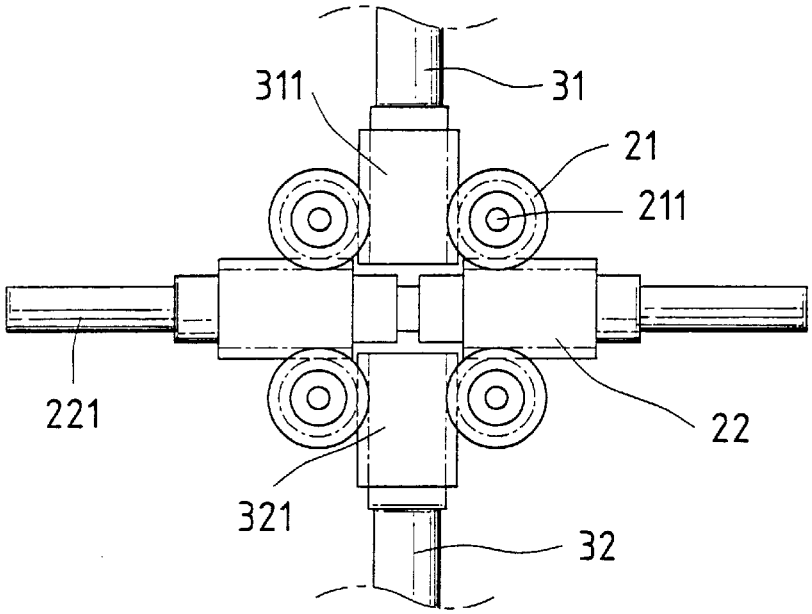
FIG. 4 is a top plane assembled view of the present invention.
Figure 5:
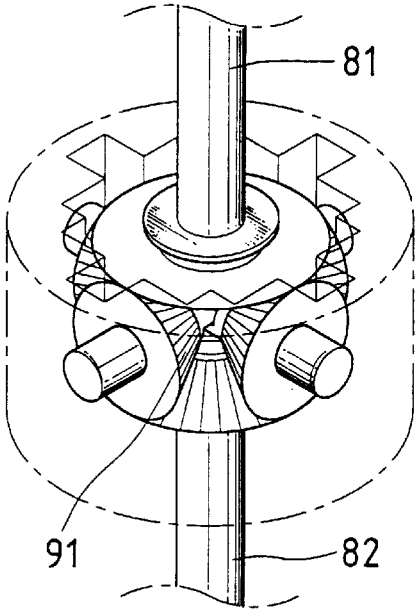
FIG.5 PRIOR ART
FIG. 5 is a perspective view of a conventional differential of remotely controlled toy car.
Figure 6:
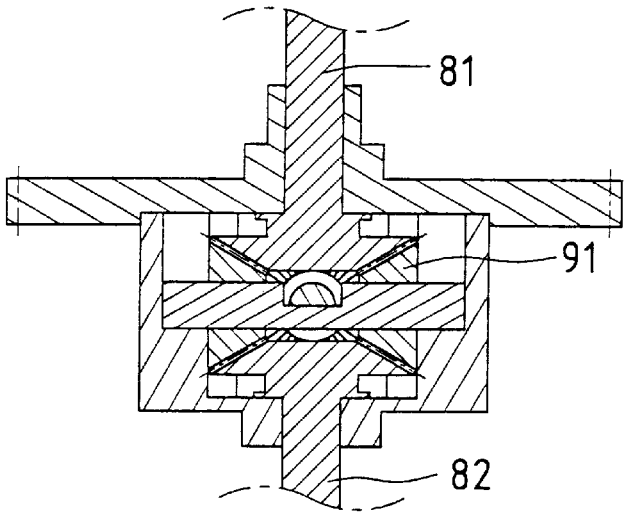
FIG.6 PRIOR ART
FIG. 6 is a sectional assembled view according to FIG. 5.
Figure 7:
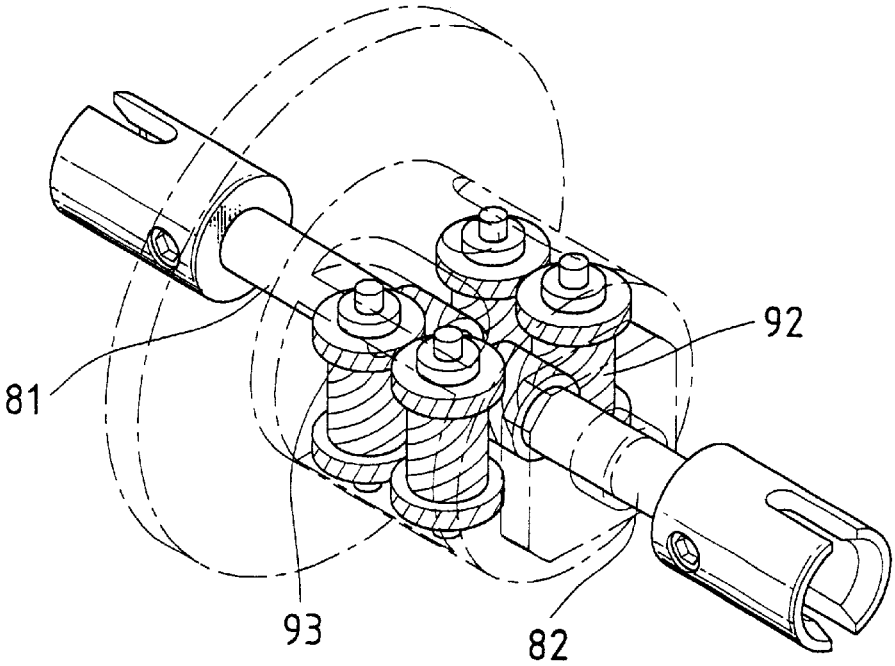
FIG.7 PRIOR ART
FIG. 7 is a perspective view of another conventional differential of remotely controlled toy car.

Referring to FIGS. 3 and 4, after assembly, the transverse spiral gears 22 and the left and right shafts 31, 32 are arranged in a cross pattern. The upright spiral gears 21 are positioned on the comers of the cross pattern. When turning, the left and right shafts 31, 32 via the spiral teeth 311 and the upright spiral gears 21 drive the transverse spiral gears 22. Then, through the upright spiral gears 21 and spiral teeth 321 on the other side, the power is transmitted to the right shaft. Therefore, a good differential modulation is achieved between the two shafts and the remotely controlled car can smoothly turn.

Please refer to FIGS. 3 and 4. In the gear set, the spiral teeth 311, 321 and the spiral gears 21, 22 are engaged with each other by 90 degrees to provide maximum torque. Therefore, during starting and turning, the wheel is effectively prevented from idling and slipping. It should be noted that the differential of the present invention only needs eight identically shaped spiral gears 21, 22 and cooperative spiral teeth 311, 321 of the left and right shafts 31, 32 to form the gear set. Therefore, it is easier to manufacture and assemble the differential and the production cost is lowered.

It should be noted that the above description and accompanying drawings are only used to illustrate one embodiment of the present invention, not intended to limit the scope thereof. Any modification of the embodiment should fall within the scope of the present invention.

What is claimed is:

1. A differential assembly for a remotely controlled toy car comprising:

a) a housing;

b) first and second wheel shafts, each having a first end with spiral teeth thereon, the first ends being spaced apart from each other and located within the housing, one of the wheel shafts being driven by a motor of the toy car;

c) a first pair of spiral gears in meshing engagement with the spiral teeth on the end of the first wheel shaft, the first pair of spiral gears being rotatable about spaced apart axes located in a plane extending perpendicular to an axis of rotation of the first wheel shaft;

d) a second pair of spiral gears in meshing engagement with the spiral teeth on the end of the second wheel shaft, the second pair of spiral gears being rotatable about spaced apart axes located in a plane extending perpendicular to an axis of rotation of the second wheel shaft; and, e) first and second transverse spiral gears rotatable on a common shaft passing between the spaced apart first ends of the wheel shafts about an axis extending perpendicular to the axes of rotation of the first and second wheel shafts and perpendicular to the axes of the first and second pairs of spiral gears, each of the transverse spiral gears in meshing engagement with one of the first pair of spiral gears and one of the second pair of spiral gears.

2. The differential assembly of claim 1, wherein the spiral teeth on the first and second wheel shafts, the first and second pairs of spiral gears, and the first and second transverse spiral gears are identically shaped.

3. The differential assembly of claim 1, wherein each of the spiral gears of the first and second pairs of spiral gears has a shaft and wherein the housing comprises first and second mating casings having indentations to receive ends of the shafts.

4. The differential assembly of claim 1, further comprising a toothed drive wheel attached to one of the first and second wheel shafts.

* * * * *